US011202948B2

(12) United States Patent
Martino

(10) Patent No.: US 11,202,948 B2
(45) Date of Patent: Dec. 21, 2021

(54) VERTICALLY DEPLOYED SPORTS GOAL

(71) Applicant: Kyle Hunter Martino, Weston, CT (US)

(72) Inventor: Kyle Hunter Martino, Weston, CT (US)

( * ) Notice: Subject to any disclaimer, the term of this patent is extended or adjusted under 35 U.S.C. 154(b) by 101 days.

(21) Appl. No.: 16/774,335

(22) Filed: Jan. 28, 2020

(65) Prior Publication Data

US 2021/0228954 A1 Jul. 29, 2021

(51) Int. Cl.

| | |
|---|---|
| ***A63B 63/00*** | (2006.01) |
| ***A63B 71/02*** | (2006.01) |
| ***A63B 63/08*** | (2006.01) |

(52) U.S. Cl.

CPC ..... *A63B 63/004* (2013.01); *A63B 71/023* (2013.01); *A63B 63/083* (2013.01); *A63B 2071/026* (2013.01); *A63B 2210/58* (2013.01)

(58) Field of Classification Search

CPC ..... A63B 63/004; A63B 63/083; A63B 2071/026; A63B 2210/58; A63B 67/00

USPC ..... 473/478

See application file for complete search history.

(56) References Cited

U.S. PATENT DOCUMENTS

| | | | | |
|---|---|---|---|---|
| 2,884,252 A | | 10/1957 | Thompson | |
| 3,981,501 A | * | 9/1976 | Gonzalez | A63B 63/008 473/477 |
| 5,186,469 A | * | 2/1993 | Terris | A63B 63/004 473/478 |
| 5,308,082 A | | 5/1994 | Bigelow | |
| 5,413,356 A | | 5/1995 | Bigelow | |
| 5,830,089 A | | 11/1998 | Halter et al. | |
| 5,839,980 A | | 11/1998 | Kendy | |
| 8,801,549 B2 | | 8/2014 | Leoni | |
| 2002/0193189 A1 | | 12/2002 | Goldwitz | |

(Continued)

FOREIGN PATENT DOCUMENTS

| | | |
|---|---|---|
| JP | 2000176065 | 6/2000 |
| WO | WO2013144069 | 10/2013 |

OTHER PUBLICATIONS

International Search Report from the International PCT Application No. PCT/US20/62571 dated Feb. 22, 2021.

(Continued)

*Primary Examiner* — John E Simms, Jr.
*Assistant Examiner* — Rayshun K Peng
(74) *Attorney, Agent, or Firm* — Davidson, Davidson & Kappel, LLC

(57) ABSTRACT

A retractable sports goal includes a base housing and a goal frame. The housing includes first and second post sections and a crossbar housing section. The goal frame includes first and second goal posts and a crossbar. The goal frame has a playing position and a retracted position. In the playing position the crossbar is extended vertically away from the crossbar housing section and the first and second goal posts are respectively extended from the first and second goal post housing sections. In the retracted position the crossbar is disposed in the crossbar housing section and the first and second goal posts are respectively disposed in the first and second goal post housing sections. A cover plate includes portions that surround the goal posts. Wheels may be attached to the bottom portions of the goal posts. A counter-weight may be provided to bias the goal frame towards the playing position.

7 Claims, 13 Drawing Sheets

(56) References Cited

U.S. PATENT DOCUMENTS

| | | | | |
|---|---|---|---|---|
| 2012/0165139 | A1 | 6/2012 | Leoni | |
| 2017/0197127 | A9 | 7/2017 | Hulbert et al. | |
| 2017/0282035 | A1* | 10/2017 | Lamascus | A63B 63/083 |
| 2018/0093150 | A1* | 4/2018 | Pratt | A63B 71/0605 |

OTHER PUBLICATIONS

Written Opinion of the International Searching Authority dated Feb. 22, 2021, from corresponding International Application No. PCT/US20/62571.

* cited by examiner

VERTICALLY DEPLOYED SPORTS GOAL

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to sports goals. More particularly, the present disclosure relates to a vertically deployed sports goal.

2. Related Art

A variety of sports games require a rectangular playing surface and a pair of sports goals. Sports playing fields, such as for soccer, field hockey, lacrosse and other sports are large in size and require considerable grass field space and related maintenance. Many facilities, such as schools and community centers, have limited funds and/or space. This is particularly the case in lower income urban localities where both funding and sports playing fields are scarce commodities. In such localities, often the only open space dedicated for outdoor sports is an asphalt or concrete basketball court.

The popularity of soccer is increasing in this country, including by youngsters to an ever-increasing degree. Soccer is an outdoor activity that may be enjoyed by players having a wide variety of skill sets and ages. Further, games such as soccer have minimal equipment requirements, other than a playing surface, soccer goals and a soccer ball. Soccer goals include a horizontal crossbar supported by a pair of goal posts, and a structural frame extending rearward from the bottom of the goal posts and providing a counter-balance to the cross-bar and goal posts, and an attached net. When not in use, soccer goals require a large storage space, preferably in a dry space to mitigate against rust and weathering, as well as to protect against vandalism. These goals must then be relocated from their storage locations to the appropriate positions upon the playing surface to be used.

Other soccer goal arrangements include collapsible soccer goals which are much smaller and lighter than their official versions as generally described above. As such by their nature, these arrangements are flimsy in comparison. Collapsible soccer goals may include a plurality of telescoping poles connected endwise to form a rectangular goal opening, support poles extending rearward from the top corners of the goal to the ground or playing surface, and an attached net. Some arrangements may include poles which are hingedly attached that enable to the goal to be unfolded to a deployed position. These collapsible soccer goals have the advantage of being readily deployable on a variety of available playing surfaces. Grass spikes (to the extent the playing surface permits) and/or physical weights, such as sandbags, may be used in an attempt to keep these goals in place during play.

In view of the foregoing, there is a need in the art for an improved sports goal.

BRIEF SUMMARY

In accordance with one embodiment, there is provided a retractable sports goal. The sports goal includes a goal frame housing. The goal frame includes a crossbar housing section with first and second housing ends. The sports goal further includes a goal frame. The goal frame has a playing position and a retracted position. The goal frame includes a crossbar having first and second crossbar ends. In the retracted position the crossbar is disposed in the crossbar housing section. In the playing position the crossbar is extended vertically away from the crossbar housing section. The goal frame further includes first and second goal posts. Each of the first and second goal posts has a top end, a bottom end and a post body disposed between the top and bottom ends. The top ends of the first and second goal posts are respectively connected to the first and second crossbar ends with the crossbar being disposed perpendicular to the first and second goal posts.

The sports goal further includes a cover plate having first and second cover ends portions, a main cover portion disposed between the first and second cover end portions, and first and second post openings. The main cover portion is positionable along the crossbar housing section. The cover plate and the crossbar housing section are cooperatively sized and configured to surround the crossbar with the goal frame in the retracted position. The first cover end portion and the main cover portion are cooperatively formed to surround the post body of the first goal post with the first goal post disposed through the first post opening and the goal frame in the playing position. The second cover end portion and the main cover portion are cooperatively formed to surround the post body of the second goal post with the second goal post disposed through the second post opening and the goal frame in the playing position.

According to various embodiments, the main cover portion may have an open position and a closed position. The main cover portion and the crossbar housing section may be cooperatively sized and configured to surround the crossbar with the goal frame in the retracted position and the main cover portion in the closed position. The main cover portion is aligned with first and second cover ends portions with the main cover portion in the closed position, and the main cover portion is not aligned with first and second cover ends portions with the main cover portion in the open position. The first post opening may be cooperatively formed by the first cover end portion and the main cover portion with the main cover portion in the closed position, and the second post opening may be cooperatively formed by the second cover end portion and the main cover portion with the main cover portion in the closed position. The sports goal may further include a hinge attached the main cover portion and the crossbar housing section for allowing the main cover portion to move between the open and closed positions. The post bodies of the first and second goal posts may be circular shaped, and the first and second post openings may be circular shaped. The main cover portion may include first and second lateral sides and front and back longitudinal sides. The front and back longitudinal sides may be parallel to each other and extend along the crossbar housing section. The first lateral side may be disposed adjacent the first cover end portion, and the second lateral side may be disposed adjacent the second cover end portion.

Further, the front longitudinal side may be longer than the back longitudinal side. The main cover portion may be hingedly attached to the crossbar housing section at the front longitudinal side. The first and second lateral sides may be disposed at 45 degrees to the front and back longitudinal sides. The first lateral side may include a first side indentation. The first cover end portion may include a first end indentation. The first side indentation and the first end indentation may cooperatively form the first post opening. The second lateral side may include a second side indentation, the second cover end portion includes a second end indentation. The second side indentation and the second end indentation may cooperatively form the second post opening. The first and second end indentations and the first and second side indentations may be all semi-circular shaped. The sports goal may further include a net attachable to the goal frame.

According to another embodiment, there is provided a retractable sports goal includes a goal frame housing and a goal frame. The goal frame housing includes a horizontal crossbar housing section having first and second housing ends. The goal frame housing further includes a first goal post housing section extending from the first housing end away from and perpendicular to the crossbar housing section. The goal frame housing further includes a second goal post housing section extending from the first housing end away from and perpendicular to the crossbar housing section. The goal frame has a playing position and a retracted position. The goal frame includes a crossbar having first and second crossbar ends. In the retracted position the crossbar is disposed in the crossbar housing section. In the playing position the crossbar is extended vertically away from the crossbar housing section. The goal frame further includes a first goal post having a first top end, a first bottom end and a first post body disposed between the first top end and the first bottom end. The first top end of the first goal post is connected to the first crossbar end with the crossbar being disposed perpendicular to the first goal post. The goal frame further includes a second goal post having a second top end, a second bottom end and a second post body disposed between the second top end and the second bottom end. The second top end of the second goal post is connected to the second crossbar end with the crossbar being disposed perpendicular to the second goal post. In the playing position the crossbar is extended vertically away from the crossbar housing section and the first and second goal posts are respectively extended from the first and second goal post housing sections. In the retracted position the crossbar is completely disposed in the crossbar housing section and the first and second goal posts are respectively disposed in the first and second goal post housing sections. The goal frame further includes first goal post wheels mounted to the first goal post sized and configured to engage the first goal post housing section in rolling contact upon the goal frame moving between the playing position and the retracted position. The goal frame further includes second goal post wheels mounted to the second goal post sized and configured to engage the second goal post housing section in rolling contact upon the goal frame moving between the playing position and the retracted position.

According to various embodiments, the first goal post wheels may include four wheels disposed equally radially about the first goal post, and the second goal post wheels may include four wheels disposed equally radially about the second goal post. The first goal post wheels may be mounted to the first goal post adjacent the first bottom end, and the second goal post wheels may be mounted to the second goal post adjacent the second bottom end. The goal frame housing may include first housing wheels mounted to the first goal post housing section sized and configured to engage the first goal post in rolling contact upon the goal frame moving between the playing position and the retracted position. The goal frame housing may further include second housing wheels mounted to the second goal post housing section sized and configured to engage the second goal post in rolling contact upon the goal frame moving between the playing position and the retracted position. The first housing wheels may include four wheels disposed equally radially about the first goal post housing section. The second housing wheels may include four wheels disposed equally radially about the second goal post housing section. The first goal post wheels may be angularly interposed between the first housing wheels about the first goal post, and the second goal post wheels may be angularly interposed between the second housing wheels about the second goal post. The sports goal may further include a counter-weight sized and configured to bias the goal frame towards the playing position. The counter-weight may be attached to the first and second goal posts via cables.

According to another embodiment, there is provided a retractable sports goal that includes a goal frame housing, a goal frame, and a counter-weight. The goal frame housing includes a horizontal crossbar housing section having first and second housing ends. The goal frame housing includes a first goal post housing section extending from the first housing end away from and perpendicular to the crossbar housing section. The goal frame further includes a second goal post housing section extending from the first housing end away from and perpendicular to the crossbar housing section. The goal frame has a playing position and a retracted position. The goal frame includes a crossbar having first and second crossbar ends. In the retracted position the crossbar is disposed in the crossbar housing section. In the playing position the crossbar is extended vertically away from the crossbar housing section. The goal frame further includes a first goal post having a first top end, a first bottom end and a first post body disposed between the first top end and the first bottom end. The first top end of the first goal post is connected to the first crossbar end with the crossbar being disposed perpendicular to the first goal post. The goal frame further includes a second goal post having a second top end, a second bottom end and a second post body disposed between the second top end and the second bottom end. The second top end of the second goal post is connected to the second crossbar end with the crossbar being disposed perpendicular to the second goal post. In the playing position the crossbar being extended vertically away from the crossbar housing section and the first and second goal posts is respectively extended from the first and second goal post housing sections. In the retracted position the crossbar is completely disposed in the crossbar housing section and the first and second goal posts being respectively disposed in the first and second goal post housing sections. The counter-weight sized and configured to bias the goal frame towards the playing position. The counter-weight may be attached to the first and second goal posts via cables.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
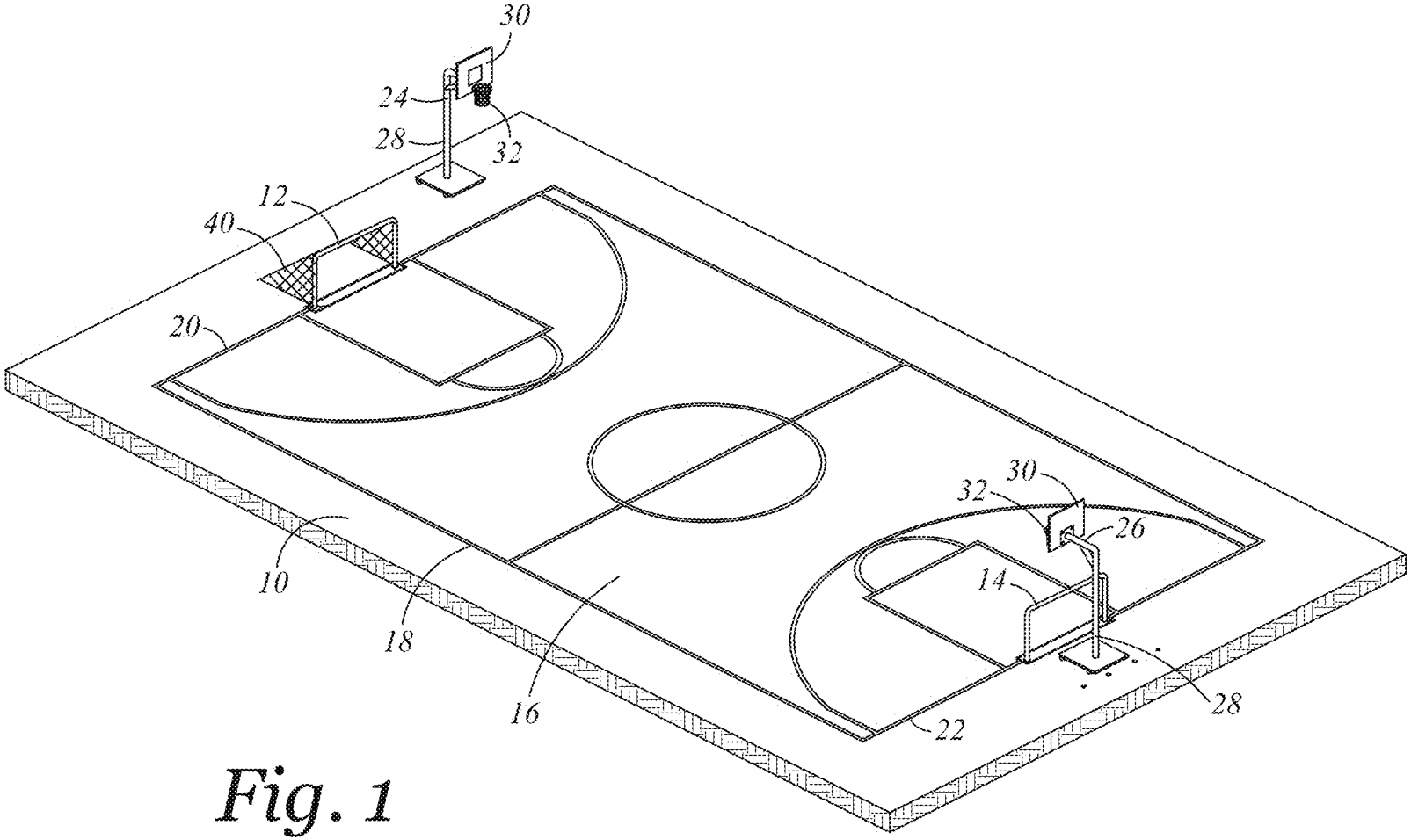
FIG. 1 is a perspective view of a playing surface including a court and a pair of retractable sports goals as installed in the playing surface according to an aspect of the invention along with a pair of mobile basketball hoops.

Referring now to FIG. 1 there is depicted a perspective view of a playing surface 10 with a pair of retractable sports goals 12, 14 as installed in the playing surface 10 according to an aspect of the invention. In this example, the playing surface 10 includes a court 16 as defined by a court boundary 18. The court boundary 18 includes a first baseline 20 and a second baseline 22. A basketball hoop 24 may be positioned at the first baseline 20 and another basketball hoop 26 may be positioned at the second baseline 22. In this embodiment, the basketball hoops 24, 26 are mobile. The basketball hoop 24 is depicted as having been moved back and the to side of its playing position adjacent the first baseline 20. The basketball hoop 26 positioned adjacent the second baseline 22. Each of the basketball hoops 24, 26 includes a pole 28 that supports a basketball backboard 30 with an attached basketball rim 32. Each basketball backboard 26 may be respectively aligned with the first and second baselines 20, 22. The retractable sports goals 12, 14 are both depicted in a playing position. It noted that the sports goal 14 is depicted without a net for ease of viewing purposes. It is also noted that in practice one would not deploy the sport goal 14 with the basketball hoop 26 also it its playing position but are depicted for reference purposes.

The retractable sports goals 12, 14 are installed in the playing surface 10 as aligned with the first and second baselines 20, 22. In this regard, the present invention recognizes that the sports goals 12, 14 may be installed relative to the court boundary 18 to allow the court boundary 18 to facilitate use in other games than basketball, such as a hardtop version of soccer, street hockey (with or without roller or inline skates, and street lacrosse. This installation allows for what otherwise would be a dedicated basketball activity space to a multi-use facilitate, allowing for the introduction of a variety activities. It is also contemplated that the sports goals 12, 14 may be installed in the court 16 for its own dedicated usage.

Figure 2:
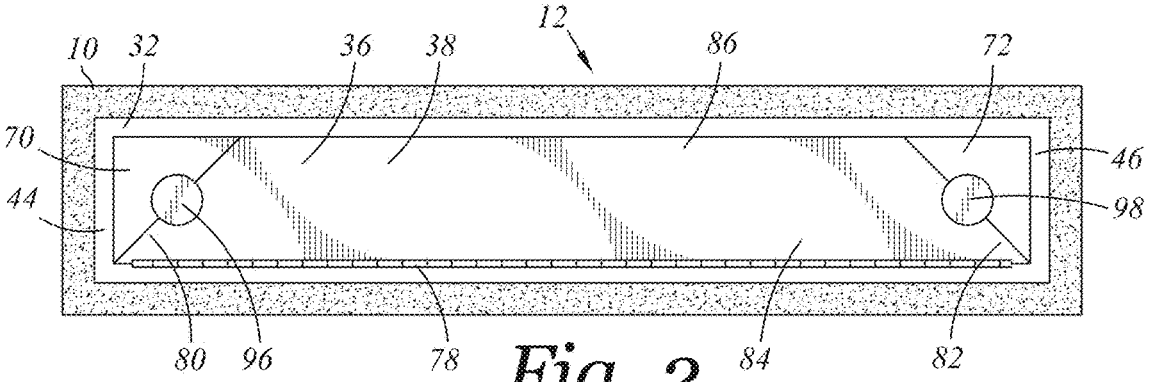
FIG. 2 is a top view of a sports goal of FIG. 1 in a retracted position with a portion of the surrounding playing surface.
Figure 3:
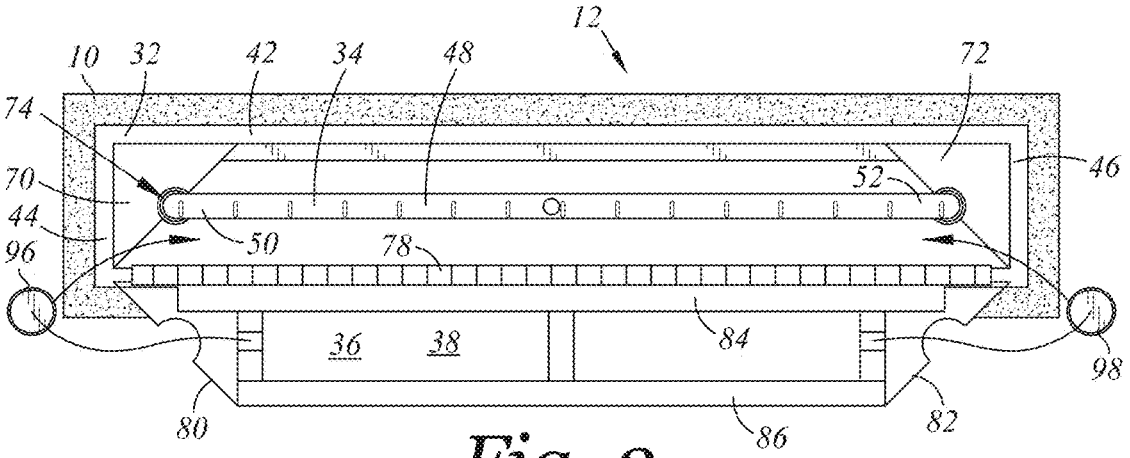
FIG. 3 is the top view of the sports goal of FIG. 2 with a goal frame in a playing position with a main cover portion in an open position.
Figure 4:
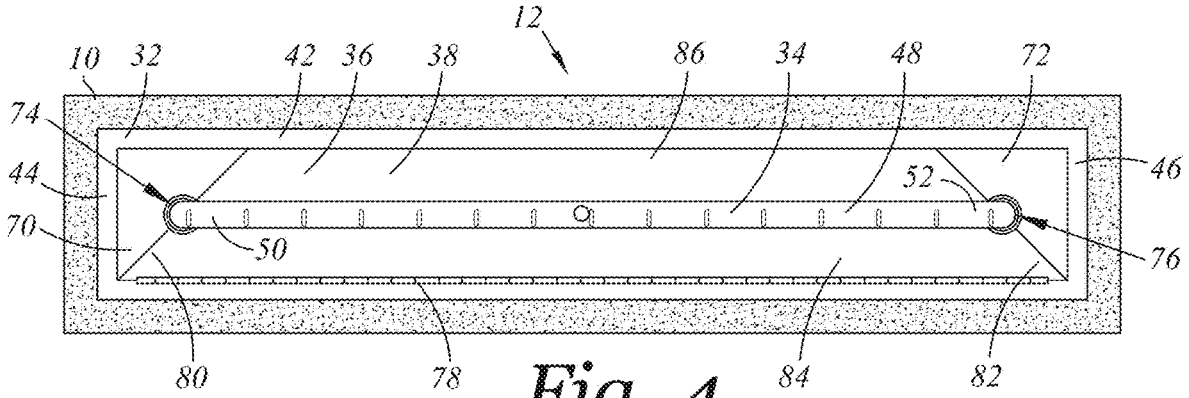
FIG. 4 is the top view of the sports goal of FIG. 2 in the goal frame in a playing position with the main cover portion in a closed position.
Figure 5:
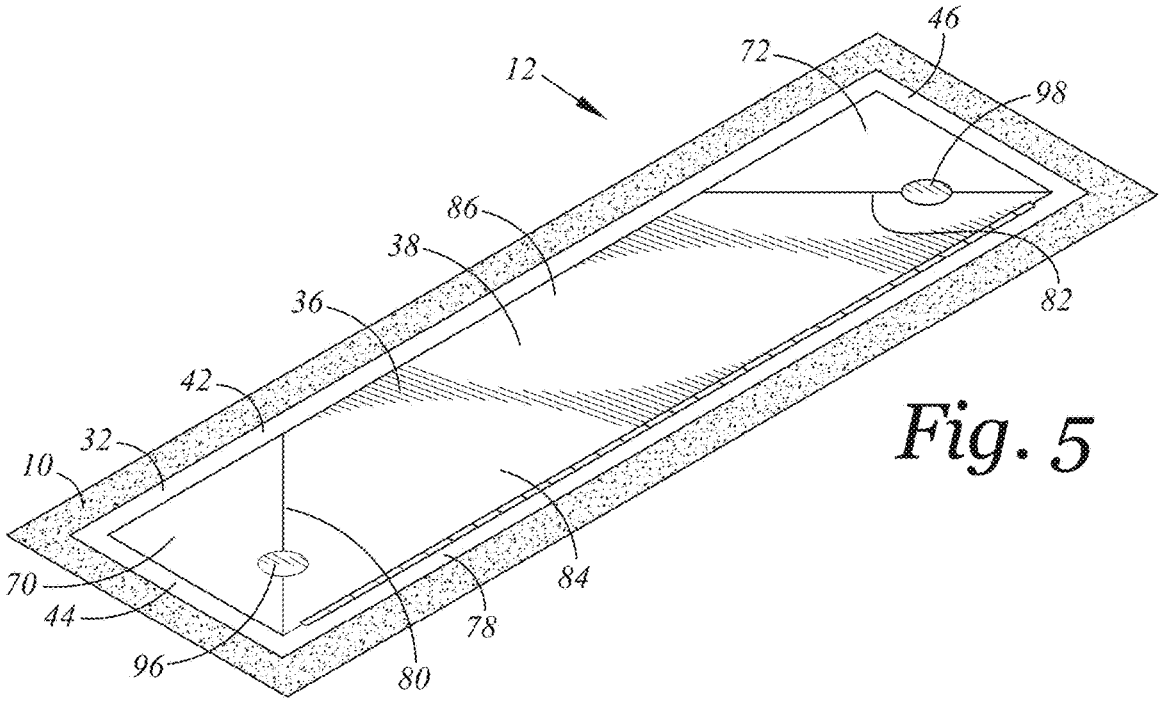
FIG. 5 is a perspective view of the sports goal of FIG. 2.
Figure 6:
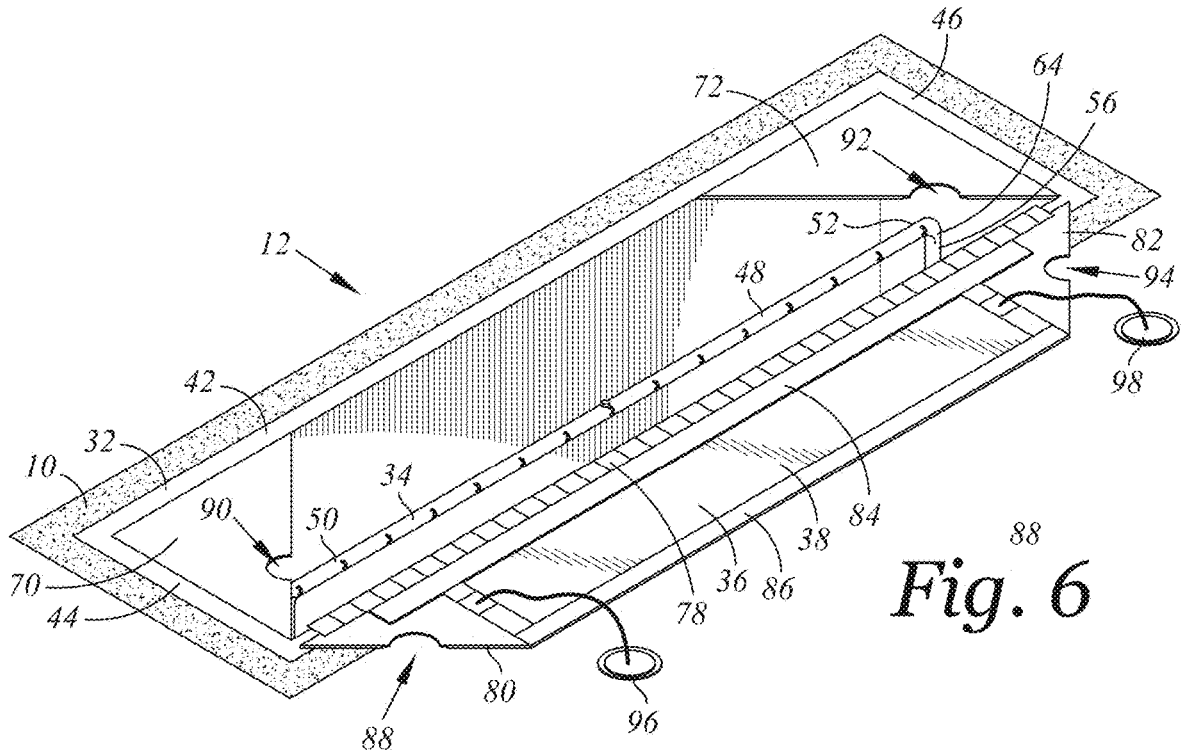
FIG. 6 is the perspective view of the sports goal of FIG. 5 with the goal frame in a retracted position and the main cover portion in the open position.
Figure 7:
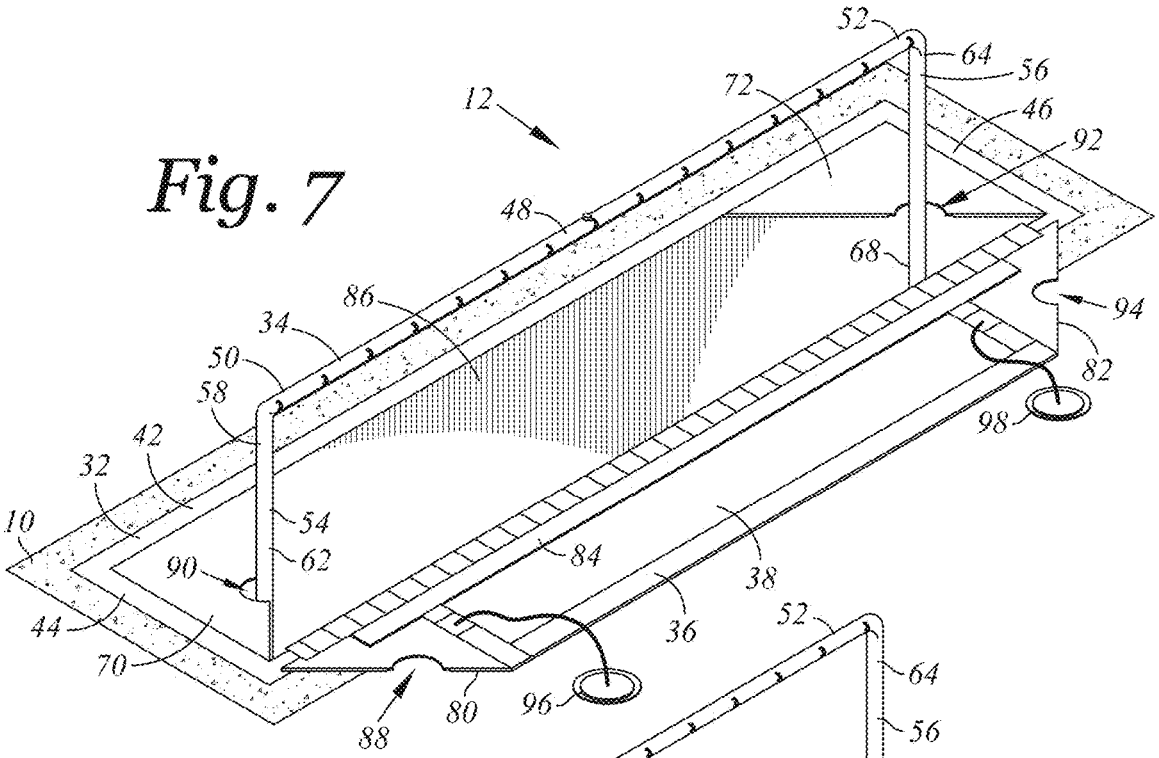
FIG. 7 is the perspective view of the sports goal of FIG. 6 with the goal frame in between the retracted position and the playing position and the main cover portion in the open position.
Figure 8:
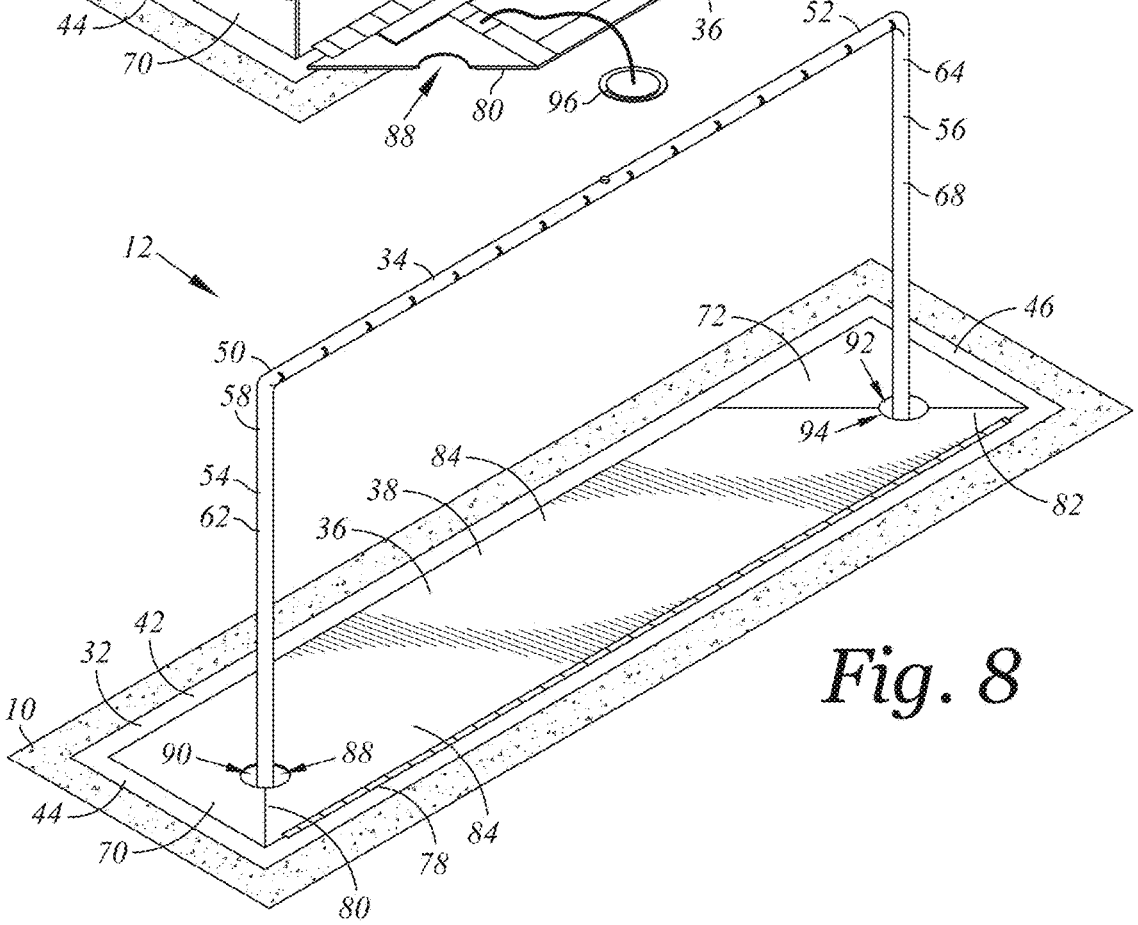
FIG. 8 is the perspective view of the sports goal of FIG. 7 with the goal frame in the playing position and the main cover portion in the closed position.
Figure 9:
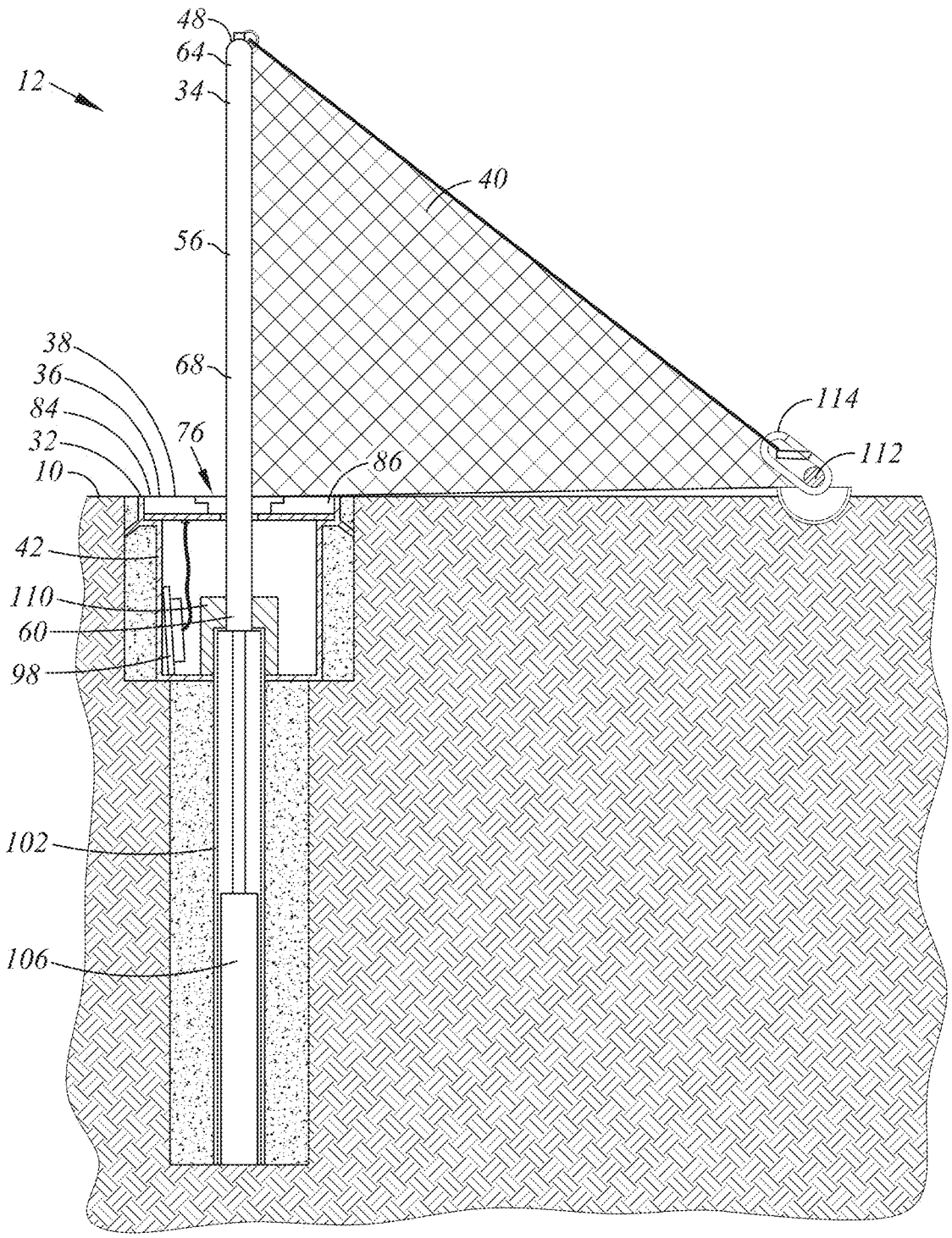
FIG. 9 is a cross sectional side view of the sports goal of FIG. 8 as shown with a net.
Figure 10:
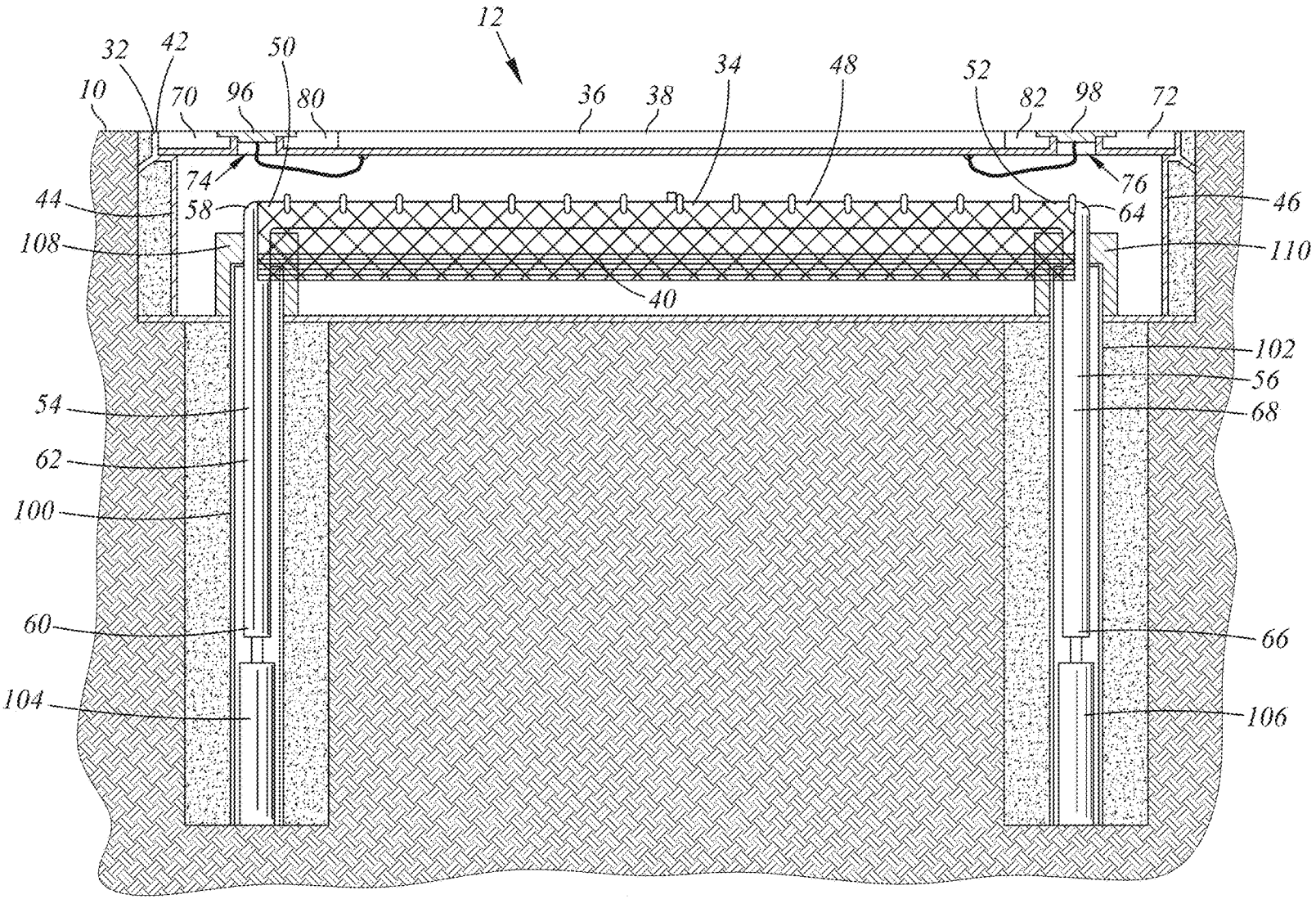
FIG. 10 is a cross sectional front view of the sports goal with the goal frame in the retracted position and the main cover portion in the closed position.
Figure 11:
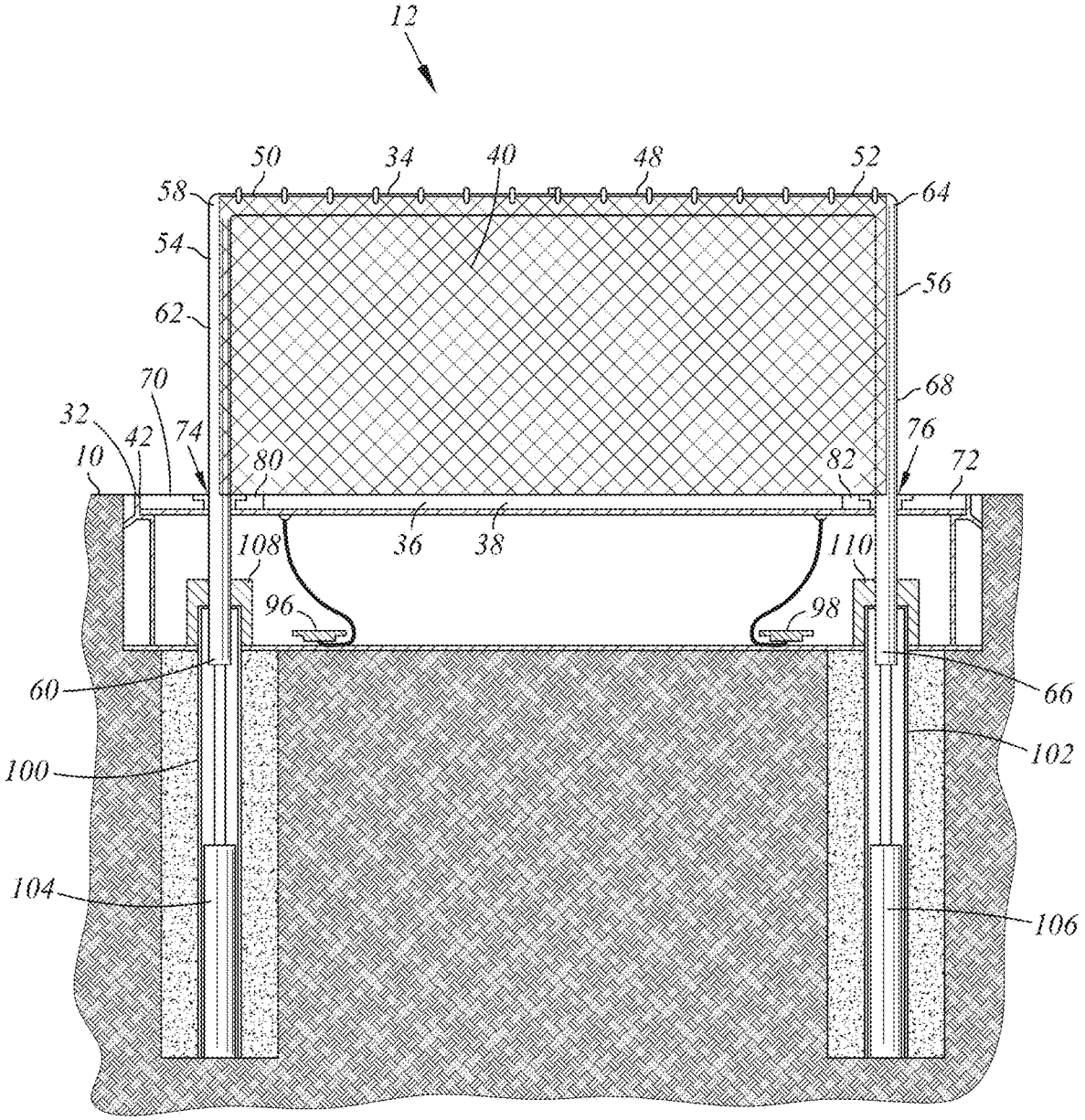
FIG. 11 is a cross sectional front view of the sports goal of FIG. 10 with the goal frame in the playing position and the main cover portion in the closed position.

With reference to FIGS. 2-11, in accordance with one embodiment, there is provided a retractable sports goal, such as the sports goal 12. The sports goal includes a goal frame housing 32 and a goal frame 34. The goal frame 12 has a playing position and a retracted position. The sports goal 12 further includes a cover plate 36 with a main cover portion 38 having an open position and a closed position. FIG. 2 is a top view of the sports goal 12 of FIG. 1 in the retracted position with a portion of the surrounding playing surface 10. FIG. 3 is the top view of the sports goal 12 of FIG. 2 with the goal frame 34 in a playing position with the main cover portion 38 in the open position. FIG. 4 is the top view of the sports goal 12 of FIG. 2 in the goal frame in 34 the playing position with a main cover portion in a closed position. FIG. 5 is a perspective view of the sports goal 12 of FIG. 2. FIG. 6 is the perspective view of the sports goal 12 of FIG. 5 with the goal frame in a retracted position and the main cover portion 38 in the open position. FIG. 7 is the perspective view of the sports goal 12 of FIG. 6 with the goal frame 34 in between the retracted position and the playing position and the main cover portion 38 in the open position. FIG. 8 is the perspective view of the sports goal 12 of FIG. 7 with the goal frame 34 in the playing position and the main cover portion 38 in the closed position. FIG. 9 is a cross sectional side view of the sports goal 12 of FIG. 8 as shown with a net 40. FIG. 10 is a cross sectional front view of the sports goal 12 with the goal frame 34 in the retracted position and the main cover portion 38 in the closed position. FIG. 11 is a cross sectional front view of the sports goal 12 of FIG. 10 with the goal frame 34 in the playing position and the main cover portion 38 in the closed position.

The goal frame housing 32 has a crossbar housing section 42 with first and second housing ends 44, 46. The goal frame 34 includes a crossbar 48 having first and second crossbar ends 50, 52. In the retracted position the crossbar 48 is disposed in the crossbar housing section 42, such as depicted in FIGS. 6 and 10. In the playing position the crossbar 48 is extended vertically away from the crossbar housing section 42, such as depicted in FIGS. 8. 9 and 11. The goal frame 34 further includes first and second goal posts 54, 56. The first goal post 54 has a top end 58, a bottom end 60 and a post body 62 disposed between the top and bottom ends 58, 60. The second goal post 56 has a top end 64, a bottom end 66 and a post body 68 disposed between the top and bottom ends 64, 66. The top ends 58, 64 of the first and second goal posts 54, 56 are respectively connected to the first and second crossbar ends 50, 52 with the crossbar 48 being disposed perpendicular to the first and second goal posts 54, 56.

The sports goal further includes the cover plate 36. The cover plate 36 has first and second cover ends portions 70, 72 with the main cover portion 38 disposed between the first and second cover end portions 70, 72. The cover plate 36 further has first and second post openings 74, 76. The main cover portion 38 is positionable along the crossbar housing section 42. The cover plate 36 and the crossbar housing section 42 are cooperatively sized and configured to surround the crossbar 48 with the goal frame 34 in the retracted position. The first cover end portion 70 and the main cover portion 38 are cooperatively formed to surround the post body 62 of the first goal post 54 with the first goal post 54 disposed through the first post opening 74 and the goal frame 34 in the playing position. The second cover end portion 72 and the main cover portion 38 are cooperatively formed to surround the post body 68 of the second goal post 56 with the second goal post 56 disposed through the second post opening 76 and the goal frame 34 in the playing position.

According to various embodiments, the main cover portion 38 may have an open position and a closed position. The main cover portion 38 and the crossbar housing section 42 may be cooperatively sized and configured to surround the crossbar 48 with the goal frame 34 in the retracted position and the main cover portion 38 in the closed position. The main cover portion 38 is aligned with first and second cover ends portions 70, 72 with the main cover portion 38 in the closed position. The main cover portion 38 is not aligned with first and second cover ends portions 70, 72 with the main cover portion 38 in the open position. This is because the main cover portion 38 is moved from a position of alignment to one which allows for access to the interior of the crossbar housing section 42.

The main cover portion 38 and the first and second cover end portions 70, 72 are configured to seamlessly blend with the adjacent playing surface 10 so as minimize any trip hazard and to mitigate against water from entering the goal frame housing 32. In this regard, the main cover portion 38 and the first and second cover end portions 70, 72 are configured to be vertically aligned with the playing surface 10 and with a minimal amount of gaps with the playing surface 10 when the main cover portion 38 in the closed position. The hinge 78 may be recessed to as to not protrude from the playing surface 10. Further, the outer surfaces of the main cover portion 38 and the first and second cover end portions 70, 72 may be include surface characteristics to be similar to the surrounding playing surface 10 and/or to not be relatively smooth so as to create in slip hazard. Various warning indicia may be imprinted upon the main cover portion 38 when rotated to the opened position so as to warn user not to "play."

The first post opening 74 may be cooperatively formed by the first cover end portion 70 and the main cover portion 38 with the main cover portion 38 in the closed position. Likewise, the second post opening 76 may be cooperatively formed by the second cover end portion 72 and the main cover portion 38 with the main cover portion 38 in the closed position. The sports goal 12 may further include a hinge 78 attached the main cover portion 38 and the crossbar housing section 42 for allowing the main cover portion 38 to move between the open and closed positions. The hinge 78 may be constructed without any portion of it extending beyond the uppermost surfaces of the main cover portion 68 and the adjacent portion of the crossbar housing section 42. This allows for a smooth horizontal transition along these surfaces with the main cover portion 38 in the closed position.

The post bodies 62, 68 of the first and second goal posts 54, 56 may be circular shaped. The first and second post openings 74, 76 may also be circular shaped. These complementary circular shapes are sized with the first and second posting openings 74, 76 being slightly bigger than the post bodies 62, 68. It is desirable to minimize any gaps between the slightly bigger diameter first and second posting openings 74, 76 compared to the post bodies 62,68. This mitigates safety issues with any openings or gaps about the post bodies 62, 68 while the main cover portion 38 is in the closed position. However, it is also desirable that the first and second post openings 74, 76 are sized so as to allow the main cover portion 38 be freely rotate between the open and closed positions without the main cover portion 38 contacting the post bodies 62, 68 with the first and second goal posts 54, 56 in the playing position.

The main cover portion 38 may include first and second lateral sides 80, 82 and front and back longitudinal sides 84, 86. The front and back longitudinal sides 84, 86 may be parallel to each other and extend along the crossbar housing section 42. The first lateral side 80 may be disposed adjacent the first cover end portion 72. The second lateral side 82 may be disposed adjacent the second cover end portion 74. Further, the front longitudinal side 84 may be longer than the back longitudinal side 86. The main cover portion 38 is hingedly attached to the crossbar housing section 42 at the front longitudinal side 84 with the hinge 78. The first lateral side 80 may include a first side indentation 88. The first cover end portion 70 may include a first end indentation 90. The first side indentation 88 and the first end indentation 90 may cooperatively form the first post opening 74. Similarly, the second lateral side 82 may include a second side indentation 92. The second cover end portion 72 includes a second end indentation 94. The second side indentation 92 and the second end indentation 94 may cooperatively form the second post opening 76. The first and second end indentations 90, 94 and the first and second side indentations 88, 92 may be all semi-circular shaped.

An aspect of the present invention recognizes that the first and second post openings 74, 76 may be configured to have a minimal size about the post bodies 62, 68 while allowing for freedom of movement of the main cover portion 38 to move between the open and closed positions. In this regard, the first and second lateral sides 80, 82 may be disposed at 45 degrees to the front and back longitudinal sides 84, 86. As such the first and second lateral sides 80, 82 are at 45 degrees relative to the axis of rotation of the main cover portion 38 (i.e., along the hinge 78). This mitered junction allows for a minimal sizing of the first and section post openings 74, 76.

The sports goal 12 may further have first and second opening covers 96, 98. The first opening cover 96 may be used to cover or otherwise be disposed in and across the first post opening 74 when the main cover portion 38 is in the closed position (such as depicted in FIGS. 2, 5 and 10). The second opening cover 98 may be used to cover or otherwise be disposed in and across the second post opening 76 when the main cover portion 38 is in the closed position. The first and second opening covers 96, 98 may be used to close up the goal frame housing 32 when the sports goal 12 is not in use and the main cover portion is the closed position and the goal frame 34 is in the retracted position. The first and second opening covers 96, 98 may be tethered to the underside of the main cover portion 38 so as to not become lost when not positioned in the first and second post openings 74, 76.

The goal frame housing 32 may include a first goal post housing section 100 and a second goal post housing section 102. The first goal post housing section 100 extends orthogonally to crossbar housing section 42 at the first housing end 44. The second goal post housing section 102 extends orthogonally to crossbar housing section 42 at the second housing end 46. In this regard, the first and second goal post housing sections 100, 102 extend vertically downward in a caisson-like manner. The first and second goal post housing sections 100, 102 are sized and configured to respectively receive the first and second goal posts 54, 56 when the goal frame 34 is in the retracted position.

A first gas spring 104 and a second gas spring 106 may be provided. The first gas spring 104 may be disposed in the first goal post housing section 100 and may be configured to support the first goal post 54 at the bottom end 60. The second gas spring 106 may be disposed in the second goal post housing section 102 and may be configured to support the second goal post 56 at the bottom end 66. The first and second gas springs 104, 106 may be sized and configured to bias the first and second goal posts upwards from the retracted position towards the playing position. At the least, the first and second gas springs 104, 106 may provide some degree of vertical force on the first and second goal posts 54, 56, which may or may not be more than the overall weight of the goal frame 34. Nonetheless, the first and second gas springs 104, 106 may be used to assist the user when deploy the goal frame 34 from the retracted position to the playing position. Though not shown, a locking mechanism may be provided to releasably retain the goal frame 34 in the retracted position, as well as the playing position. Such mechanism may be released to allow for the deployment of the goal frame 34 from the retracted position. Once the goal frame 34 is in its playing position, the goal frame 34 may be temporarily locked into place with the locking mechanism. This is provided as a safety feature to mitigate against the goal frame 34 from inadvertently collapsing from the playing position. This may be as simple as providing spring loaded locking pins or cotter pins. The first and second gas springs 104, 106 may also be configured to provide a damping effect when lowering the goal frame 34 from the playing position so as to avoid the goal frame 34 from rapidly dropping in an unsafe manner.

A first goal post base 108 may be provided in the goal frame housing 32 at the first housing end 44 adjacent the crossbar housing section 42, and a second goal post base 110 may be provided in the goal frame housing 32 at the second housing end 46 adject the crossbar housing section 42. The first and second goal post bases 108, 110 provide structural support and stability to the first and second goal posts 54, 56, especially when the goal frame 34 is in the fully deployed playing position.

The sports goal 12 may further include the net 40 attachable to the goal frame 34. The net 40 may be attached to the goal frame 34 through a series of clips, rings and the like about the rear-facing side of the first and second goal posts 54, 56 and the crossbar 48. It is contemplated that the net 40 may be attached even while the goal frame 40 is in the retracted position. This allows the goal frame 34 to be deployed in the playing position and the net 40 is substantially in a condition for play. A rearward portion of the net 40 may further be attached to the playing surface 10 with the use of retaining members 112 and carabiners 114 (such as depicted in the side view of FIG. 12).

It is contemplated that the material selections for the various components of the sports goal 12 and the related manufacturing processes thereof may be chosen from any of those which are well known to one of ordinary skill in the art. For example, the goal frame housing 30 and the goal frame 34 may all be formed of metal, such as steel tubing and plates, of a variety of types and thicknesses with a variety of surface treatments.

Referring now to FIGS. 12 through 16 there is provided a sports goal 116 according to another embodiment. The sports goal 116 is generally similar to the sports goal 12, however with the various differences as notice. In this regard, like reference numerals indicate like structures. Thus, similar referenced structures are as described above but with those differences noted.

Figure 12:
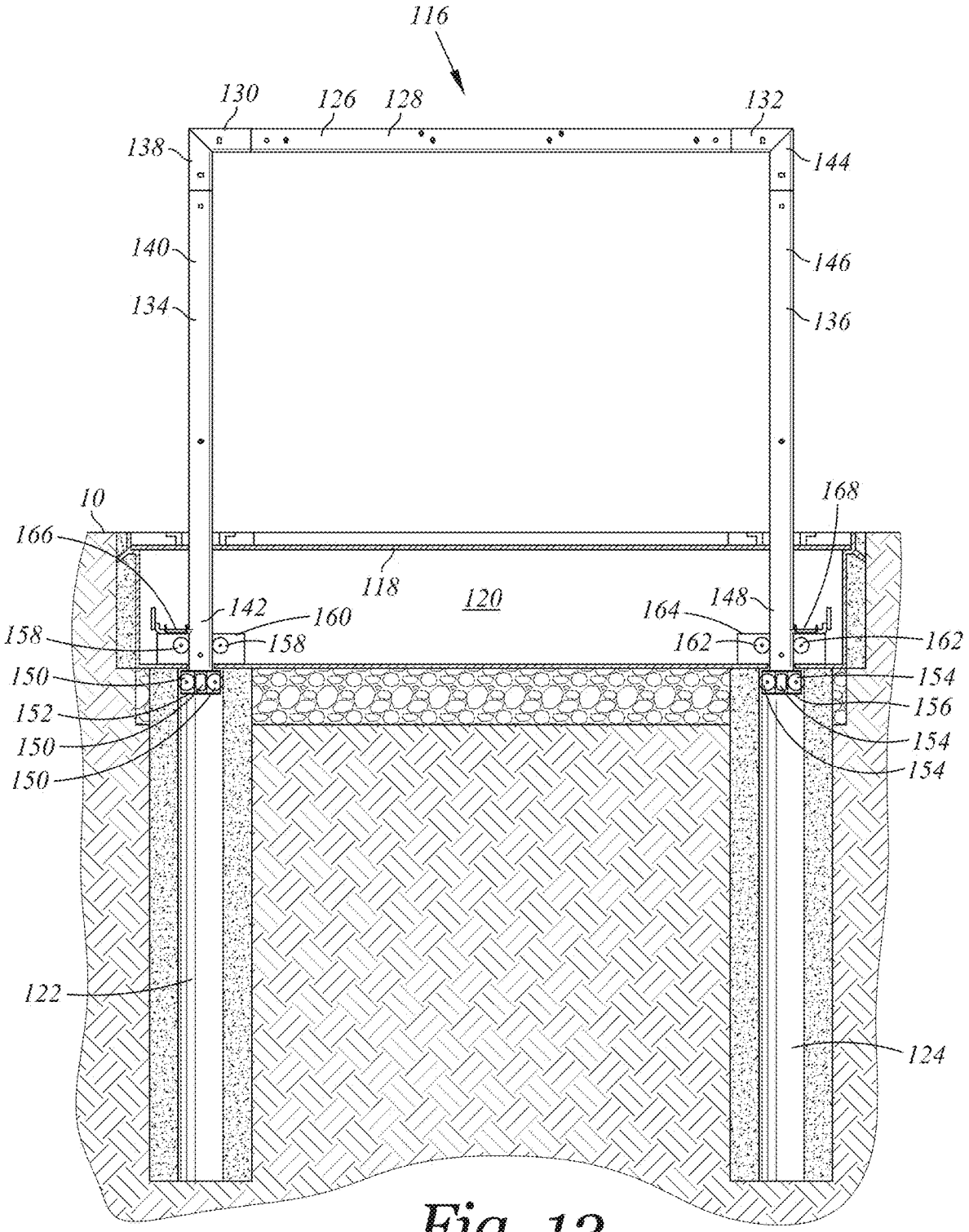
FIG. 12 is a cross sectional front view of a sports goal according to another embodiment with a goal frame in a playing position.
Figure 13:
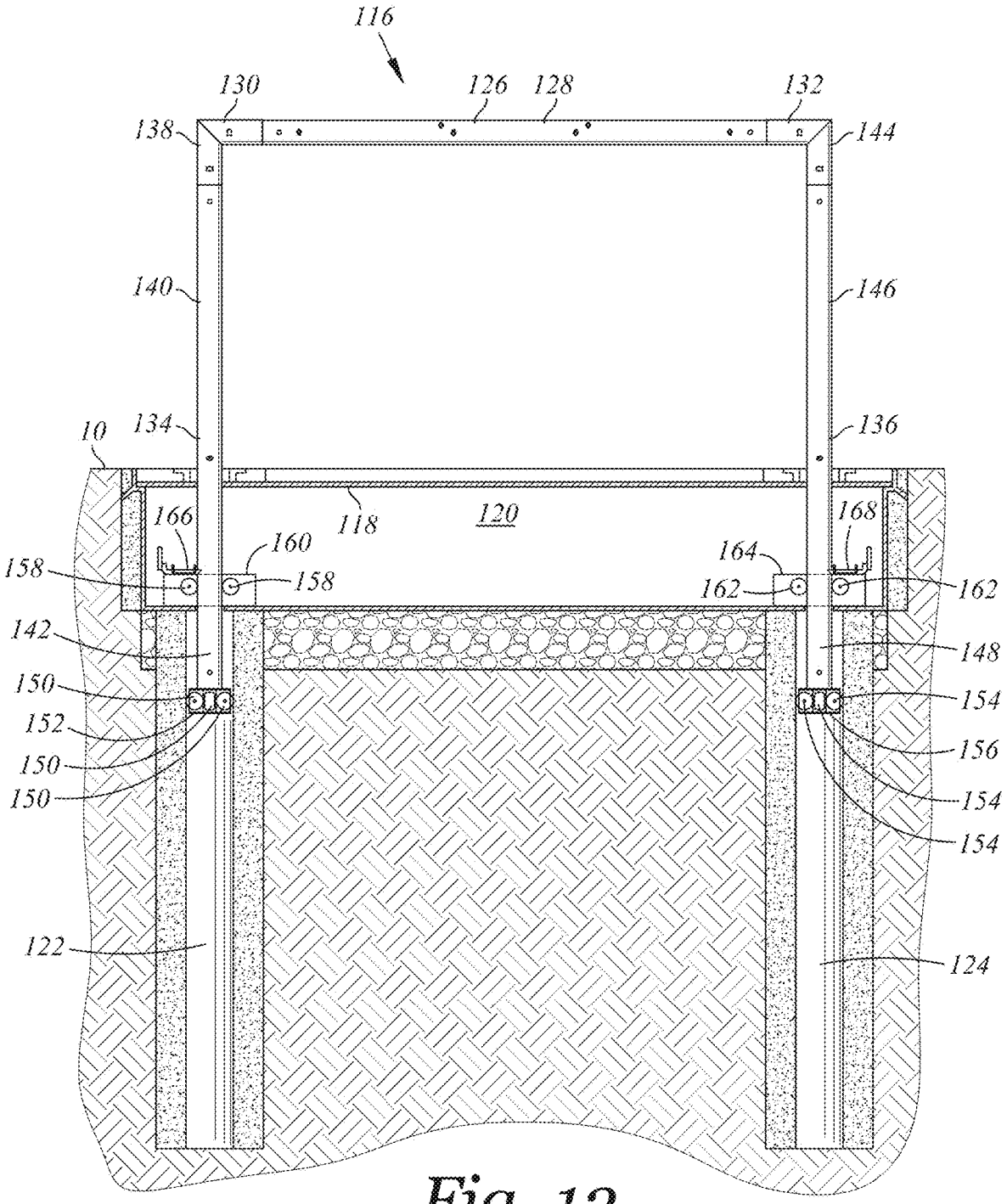
FIG. 13 is a cross sectional front view of the sports goal of FIG. 12 with the goal frame in between the retracted position and the playing position.
Figure 14:
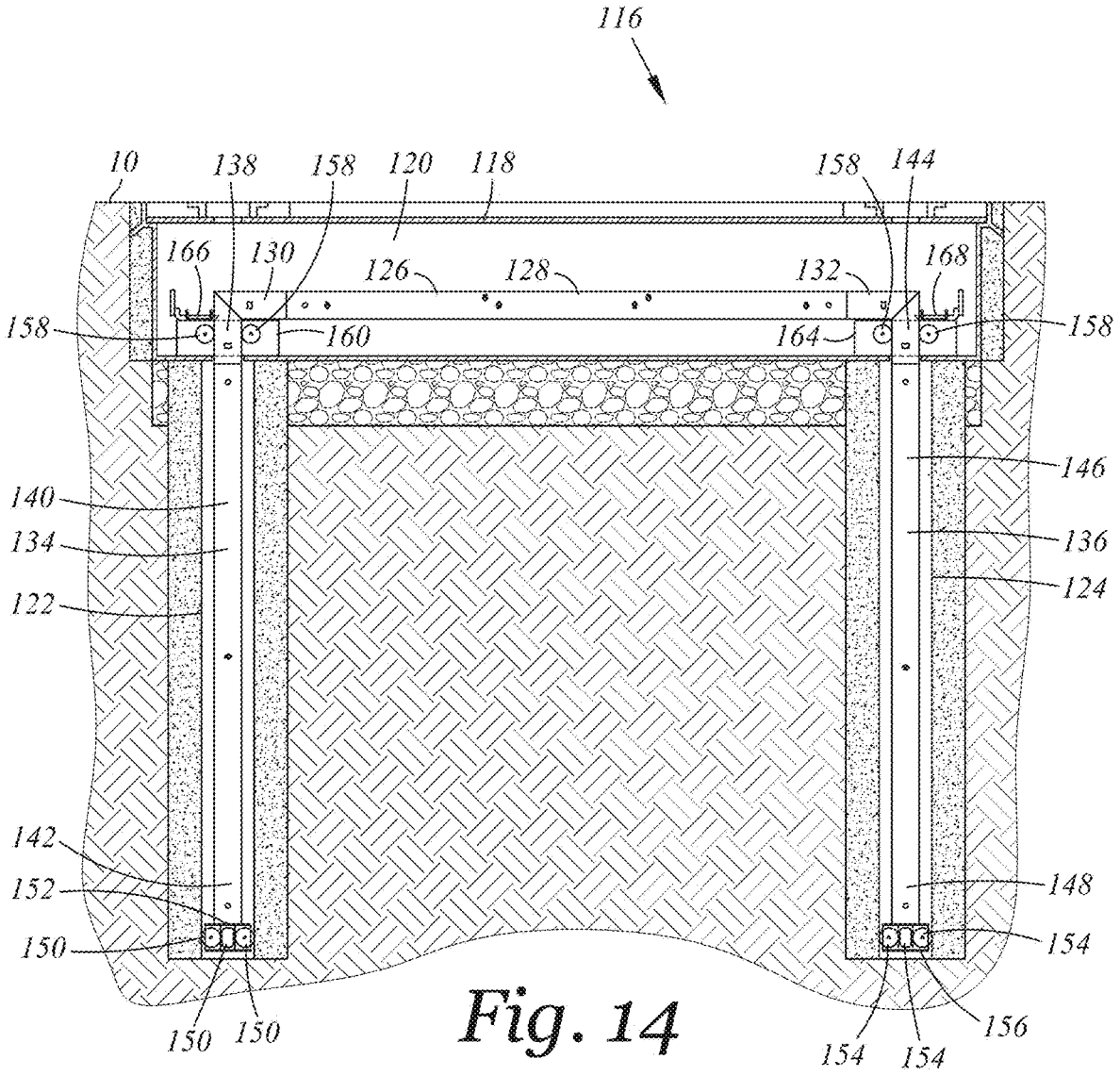
FIG. 14 is a cross sectional front view of the sports goal of FIG. 13 with the goal frame in the retracted position.
Figure 15:
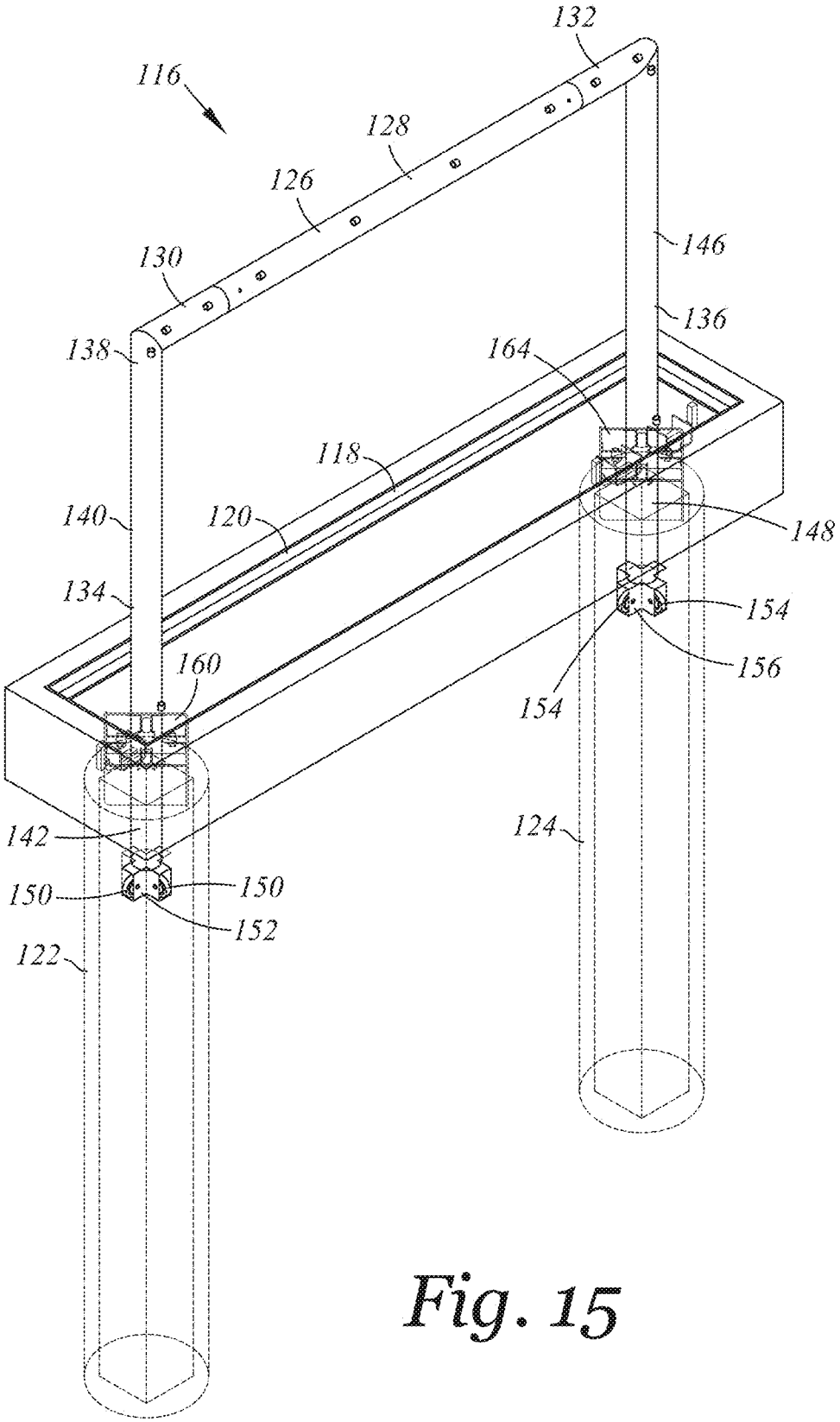
FIG. 15 is a perspective view of the sports goal of FIG. 13 with a goal frame housing without any cover (with a portion of first and second goal posts of the goal frame and first and second goal posts housing sections in dashed lining)
Figure 16:
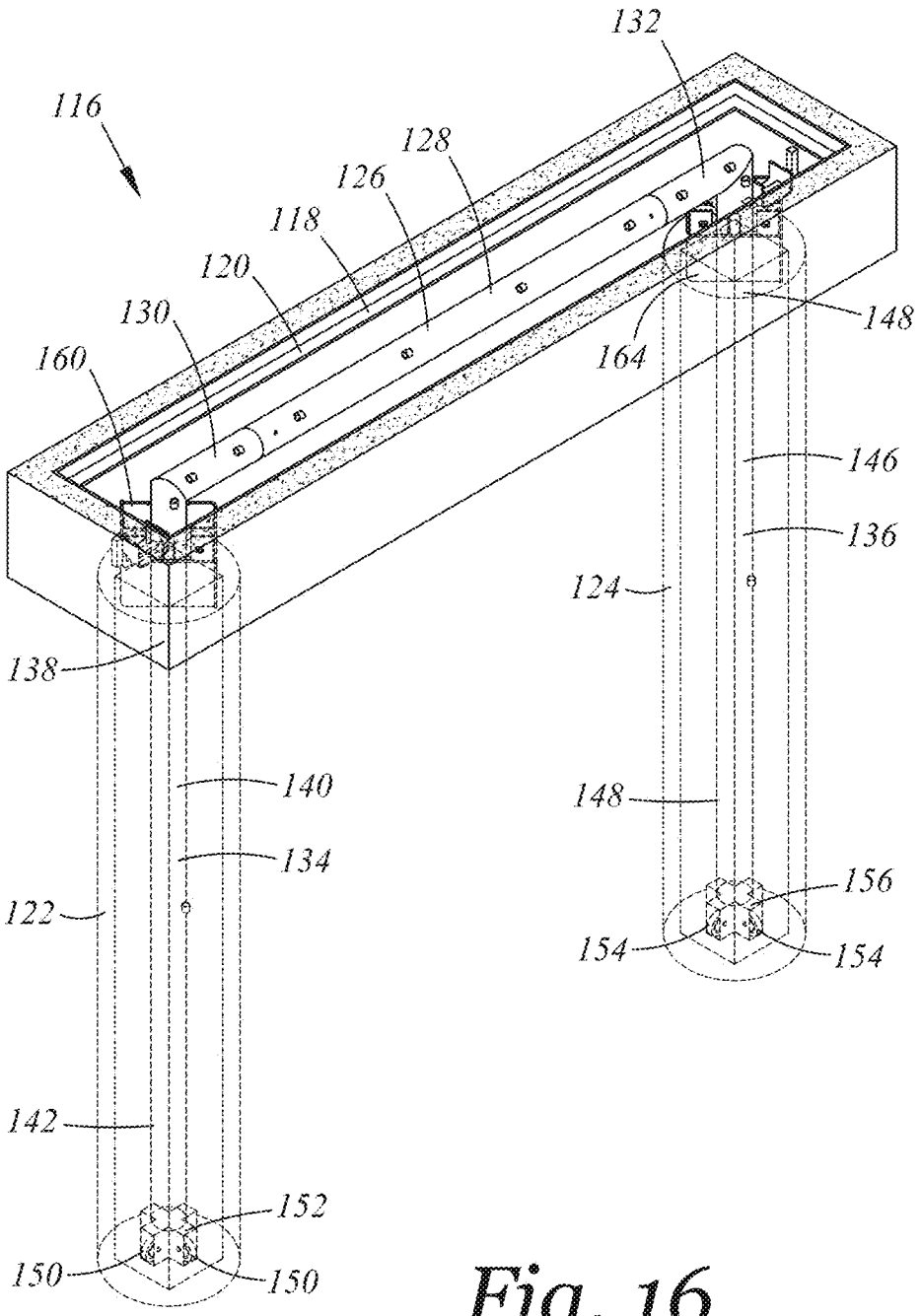
FIG. 16 is the perspective view of the sports goal of FIG. 15 with the goal frame in the retracted position (with a portion of the first and second goal posts of the goal frame and first and the second goal posts housing sections in dashed lining)

FIG. 12 is a cross sectional front view of the sports goal 116 according to another embodiment with a goal frame 126 in a playing position. FIG. 13 is a cross sectional front view of the sports goal 116 of FIG. 12 with the goal frame 126 in between the retracted position and the playing position. FIG. 14 is a cross sectional front view of the sports goal 116 of FIG. 13 with the goal frame 126 in the retracted position. FIG. 15 is a perspective view of the sports goal 116 of FIG. 13 with a goal frame housing 118 without any cover (with a portion of first and second goal posts 134, 136 of the goal frame 126 and first and second goal post housing sections 122, 124 in dashed lining). FIG. 16 is the perspective view of the sports goal 116 of FIG. 15 with the goal frame 126 in the retracted position (with a portion of the first and second goal posts 134, 136 of the goal frame 126 and the first and second goal post housing sections 122, 124 in dashed lining).

In this embodiment, the goal frame housing 118 includes a horizontal crossbar housing section 120 and the first and second goal post housing sections 122, 124. The goal frame 126 includes a crossbar 128 and the first and second goal posts 134, 136. The cross bar 128 has opposing first and second crossbar ends 130, 132. The first goal post 134 includes a first top end 138, an opposing first bottom end 140, and a first post body 142 disposed between the first top end 138 and the first bottom end 140. The second goal post 136 includes a second top end 144, an opposing second bottom end 146, and a second post body 148 disposed between the second top end 144 and the second bottom end 146. The first goal post 134 extends perpendicularly from the crossbar 128 with the first top end 138 attached to the first crossbar end 130, and the second goal post 136 extends perpendicularly from the crossbar 128 with the second top end 144 attached to the second crossbar end 132.

The goal frame 126 has a playing position and a retracted position. In the retracted position the crossbar 128 is disposed in the crossbar housing section 120. In the playing position the crossbar 128 is extended vertically away from the crossbar housing section 120. In the playing position the crossbar 128 is extended vertically away from the crossbar housing section 120 and the first and second goal posts 134, 136 are respectively extended from the first and second goal post housing sections 122, 124. In the retracted position the crossbar 128 is completely disposed in the crossbar housing section 120 and the first and second goal posts 134, 136 are respectively disposed in the first and second goal post housing sections 122, 124.

The goal frame 126 further includes first goal post wheels 150 mounted to the first goal post 134 sized and configured to engage the first goal post housing section 122 in rolling contact upon the goal frame 126 moving between the playing position and the retracted position. The goal frame 126 further includes second goal post wheels 154 mounted to the second goal post 136 sized and configured to engage the second goal post housing section 124 in rolling contact upon the goal frame 126 moving between the playing position and the retracted position. In this regard, the first and second goal post wheels 150, 152 are respectively configured to spin about axes of rotation that are orthogonal to the longitudinal axis of each of the first and second goal posts 134, 136. As such, the first and second goal post wheels 150, 154 are respectively configured to roll in the direction along the longitudinal axes of the first and second goal posts 134, 136 (i.e., in a vertical direction).

According to various embodiments, the first goal post wheels 150 may include four wheels disposed equally radially about the first goal post 134, and the second goal post wheels 154 may include four wheels disposed equally radially about the second goal post 136. The first goal post wheels 150 may be mounted to the first goal post 134 adjacent the first bottom end 140, and the second goal post wheels 154 may be mounted to the second goal post 136 adjacent the second bottom end 146. A first post wheel support 152 may be provided that is used to rotatably attach the first goal post wheels 150 to the first goal post 134 adjacent the first bottom end 140. A second post wheel support 156 may be provided that is used to rotatably attach the second goal post wheels 154 to the second goal post 136 adjacent the second bottom end 146.

Further, the first goal post housing section 122 may be cooperatively sized and configured to be slightly larger than the arrangement of the first goal post wheels 150. In this regard, the first goal post housing section 122 may have a square cross section with each side being in rolling contact with a respective one of the first goal post wheels 150. Similarly, the second goal post housing section 124 may be cooperatively sized and configured to be slightly larger than the arrangement of the second goal post wheels 150. In this regard, the second goal post housing section 124 may have a square cross section with each side being in rolling contact with a respective one of the second goal post wheels 154. This configuration allows for the first and second goal posts 134, 136 to be centered respectively within the first and second goal post housing sections 122, 124.

The goal frame housing 118 may include first housing wheels 158 mounted to the first goal post housing section 122 sized and configured to engage the first goal post 134 in rolling contact upon the goal frame 126 moving between the playing position and the retracted position. The goal frame housing 118 may further include second housing wheels 162 mounted to the second goal post housing section 124 sized and configured to engage the second goal post 136 in rolling contact upon the goal frame 126 moving between the playing position and the retracted position.

A first housing wheel support 160 may be provided that is used to rotatably attach the first housing wheels 158 to crossbar housing section 120 adjacent the first goal post housing section 122. A second housing wheel support 164 may be provided that is used to rotatably attach the second housing wheels 162 to crossbar housing section 120 adjacent the second goal post housing section 124. The first housing wheels 158 may include four wheels disposed equally radially about the first goal post housing section 134. The second housing wheels 162 may include four wheels disposed equally radially about the second goal post housing section 136. This configuration further allows for the first and second goal posts 134, 136 to be centered respectively within the first and second goal post housing sections 122, 124.

The first goal post wheels 150 may be angularly interposed between the first housing wheels 158 about the first goal post 134, and the second goal post wheels 154 may be angularly interposed between the second housing wheels 162 about the second goal post 136. This interposed arrangement allows for the first and second goal posts 134, 136 to be assembled into the first and second goal post housing sections 122, 124 without the first goal post wheels 150 interfering with the first housing wheels 158 and the second goal post wheels 154 interfering with the second housing wheels 162 during the assembly process. As such, the first goal post wheels 150 are respectively able to pass through and among the first housing wheels 158 upon the first bottom end 140 being positioned in the first goal post housing section 122, and the second goal post wheels 154 are respectively able to pass through and among the second housing wheels 162 upon the second bottom end 146 being positioned in the second goal post housing section 124.

There may be provided locking levers 166, 168. The locking lever 166, 168 may be respectively used to engage and controllably lock into place the first and second goal posts 134, 136 relative to the goal frame housing 118 when the goal frame 126 is in the playing position.

Figure 17:
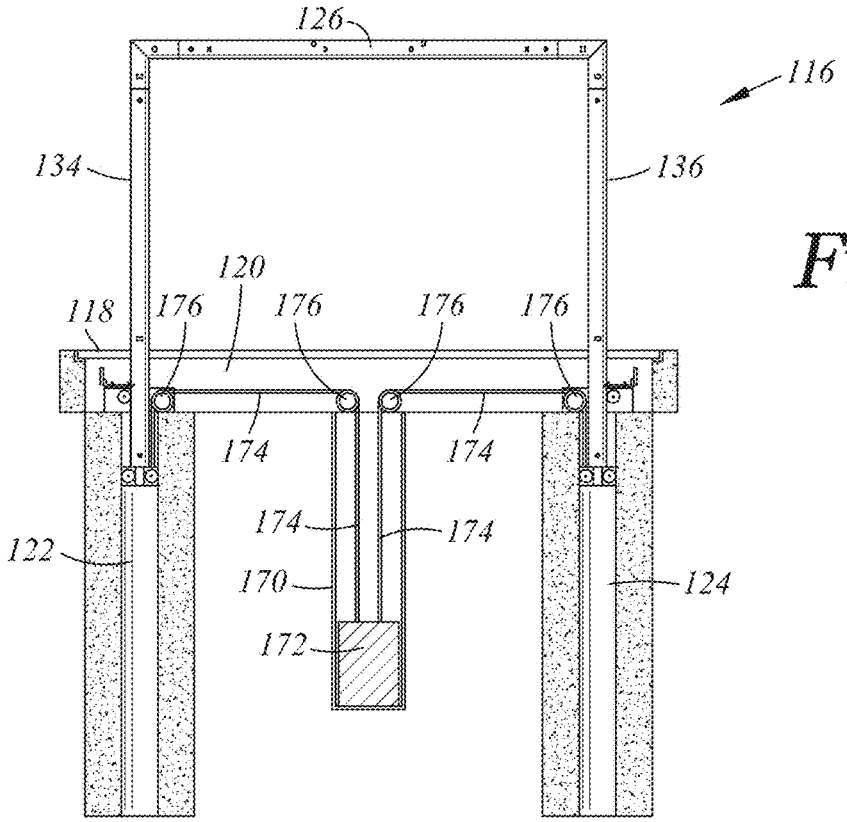
FIG. 17 is a cross sectional front view of a sports goal according to another embodiment with counter-weight and a goal frame in a playing position.
Figure 18:
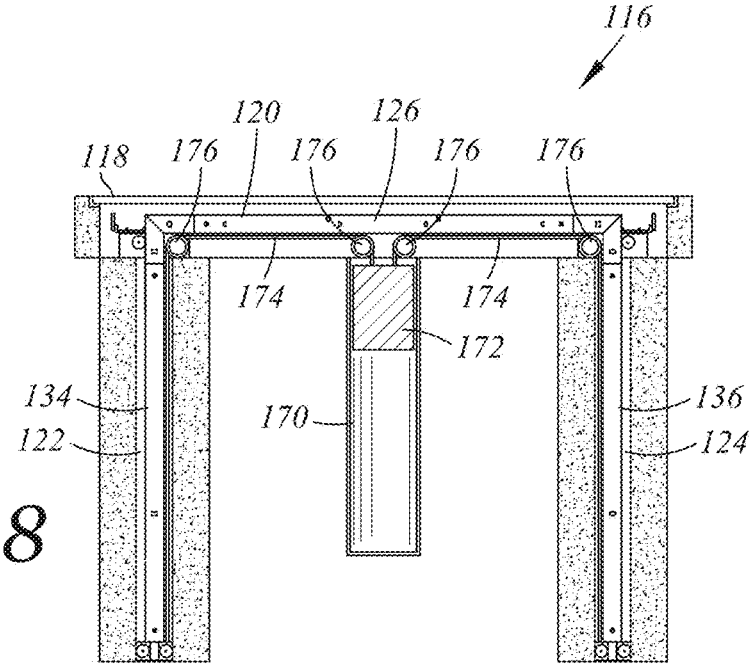
FIG. 18 is a cross sectional front view of the sports goal of FIG. 17 with the goal frame in a retracted position.

Referring now to FIGS. 17 through 18 there is provided the sports goal 116 according to another embodiment with the various differences as notice. In this regard, like reference numerals indicate like structures. Thus, similar referenced structures are as described above but with those differences noted. FIG. 17 is a cross sectional front view of the sports goal 116 according to another embodiment with a counter-weight 172 and the goal frame 126 in a playing position. FIG. 18 is a cross sectional front view of the sports goal of FIG. 17 with the goal frame 126 in a retracted position. The goal frame housing 118 may further include a counter-weight housing section 170. The counter-weight housing section 170 extends vertically downward from the crossbar housing section 120 parallel to the first and second goal post housing sections 122, 124. The sports goal 116 may further include the counter-weight 172 sized and configured to bias the goal frame 126 towards the playing position. The counter-weight 172 may be attached to the first and second goal posts via cables 174 and pulleys 176. The counter-weight 172 is positioned in the counter-weight housing section 170. The cables 174 are attached to the counter-weight 172 and respectively mechanically connect to the first and second bottom ends 140, 146. With this arrangement, the counter-weight 172 is configured to move vertically with its weight being counteracted upon by pulling of the attached cables 174. The tension in the cables 172 imparts a pulling force upon the first and second goal posts 134, 136.

During the construction and installation phase of deploying the sports goal 116, the ground or soil preparation would include trenching and digging holes for the first and second goal post housing 122, 124. It is contemplated it would be a simple additional task to dig out a hole to accommodate the counter-weight housing section 170 as well. The use of the counter-weight 172 is a relatively low cost and low-tech solution providing an assistive force to help move the goal frame 126 into the playing position. This also provides a counter-force to prevent the goal frame 126 from rapidly falling into the retracted position.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A retractable sports goal comprising:

a goal frame housing including:

a horizontal crossbar housing section having first and second housing ends;

a first goal post housing section extending from the first housing end away from and perpendicular to the crossbar housing section; and a second goal post housing section extending from the first housing end away from and perpendicular to the crossbar housing section; and a goal frame having a playing position and a retracted position, the goal frame including:

a crossbar having first and second crossbar ends, in the retracted position the crossbar is disposed in the crossbar housing section, in the playing position the crossbar is extended vertically away from the crossbar housing section; and a first goal post having a first top end, a first bottom end and a first post body disposed between the first top end and the first bottom end, the first top end of the first goal post being connected to the first crossbar end with the crossbar being disposed perpendicular to the first goal post; and a second goal post having a second top end, a second bottom end and a second post body disposed between the second top end and the second bottom end, the second top end of the second goal post being connected to the second crossbar end with the crossbar being disposed perpendicular to the second goal post, in the playing position the crossbar being extended vertically away from the crossbar housing section and the first and second goal posts being respectively extended from the first and second goal post housing sections, in the retracted position the crossbar being completely disposed in the crossbar housing section and the first and second goal posts being respectively disposed in the first and second goal post housing sections;

first goal post wheels mounted to the first goal post sized and configured to engage the first goal post housing section in rolling contact upon the goal frame moving between the playing position and the retracted position;

second goal post wheels mounted to the second goal post sized and configured to engage the second goal post housing section in rolling contact upon the goal frame moving between the playing position and the retracted position; and wherein the goal frame housing includes first housing wheels mounted to the first goal post housing section sized and configured to engage the first goal post in rolling contact upon the goal frame moving between the playing position and the retracted position, the goal frame housing further includes second housing wheels mounted to the second goal post housing section sized and configured to engage the second goal post in rolling contact upon the goal frame moving between the playing position and the retracted position.

2. The sports goal of claim 1 wherein the first goal post wheels include four wheels disposed equally radially about the first goal post, the second goal post wheels include four wheels disposed equally radially about the second goal post.

3. The sports goal of claim 1 wherein the first goal post wheels are mounted to the first goal post adjacent the first bottom end, the second goal post wheels are mounted to the second goal post adjacent the second bottom end.

4. The sports goal of claim 1 wherein the first housing wheels include four wheels disposed equally radially about the first goal post housing section, the second housing wheels include four wheels disposed equally radially about the second goal post housing section.

5. The sports goal of claim 1 wherein the first goal post wheels are angularly interposed between the first housing wheels about the first goal post, the second goal post wheels are angularly interposed between the second housing wheels about the second goal post.

6. The sports goal of claim 1 further includes a counter-weight sized and configured to bias the goal frame towards the playing position.

7. The sports goal of claim 6 wherein the counter-weight is attached to the first and second goal posts via cables.

* * * * *